US006711974B1

(12) United States Patent
Lin

(10) Patent No.: US 6,711,974 B1
(45) Date of Patent: Mar. 30, 2004

(54) POSITIONING DEVICE FOR HOLDING A HOOK SCREW

(76) Inventor: Ying-Mo Lin, No. 161, Lane 243, Sec. 2, Chang Shin Rd., He Mei Jen, Chang Hua Hsien (TW)

( * ) Notice: Subject to any disclaimer, the term of this patent is extended or adjusted under 35 U.S.C. 154(b) by 0 days.

(21) Appl. No.: 10/305,904

(22) Filed: Nov. 27, 2002

(51) Int. Cl.[7] ..... B25B 13/02
(52) U.S. Cl. ..... 81/125; 81/901
(58) Field of Search ..... 81/125, 901, 124.2, 81/129, 146, 150, 487, 451, 452, 453

(56) References Cited

U.S. PATENT DOCUMENTS 562,041 A * 6/1896 Seymour ..... 81/901
882,937 A * 3/1908 Fegley ..... 81/124.2
4,724,731 A * 2/1988 Onofrio ..... 81/124.2
5,335,569 A * 8/1994 Rowley ..... 81/125
5,425,290 A * 6/1995 Fought et al. ..... 81/124.2
6,230,592 B1 * 5/2001 Hsiao ..... 81/125
6,530,299 B1 * 3/2003 Liu ..... 81/125

* cited by examiner

*Primary Examiner*—Hadi Shakeri
(74) *Attorney, Agent, or Firm*—Charles E. Baxley

(57) ABSTRACT

A positioning device for holding hook screws includes a tubular body with a passage defined longitudinally therethrough and two slots are defined through a wall of the body. One of the slots communicates a first open end of the body so that a hook portion of a hook screw can be slid in the first slot and a magnet is embedded in the wall of the body so as to attract the hook portion. A holding assembly is mounted to the body and includes a first piece movably mounted to the body and a second piece fixedly mounted to the body. A spring is mounted to the body and biased between the first piece and the second piece. The hook portion is engaged with the first piece. A rod is movably inserted into the passage via the second open end of the body and has a magnet connected to a distal end of the rod so as to attract the hook portion of the hook screw.

5 Claims, 5 Drawing Sheets

POSITIONING DEVICE FOR HOLDING A HOOK SCREW

FIELD OF THE INVENTION

The present invention relates to a positioning device for holding a hook screw which is inserted in a slot of the device and attracted by a magnet so that the user needs not to hold the hook screw by his hand.

BACKGROUND OF THE INVENTION

A conventional hook screw generally includes a hook portion and a shank portion which extends from the hook portion and includes threads defined in an outer periphery of the shank. The hook screw is fixed to a wall by the threaded shank and the hook portion is convenient for hooking an object. It is inconvenient to fix the hook screw on walls because the hook portion is flat and large that is not easily to be held by hand and the other hand of the user operates the tool to rotate or punch the hook screw on walls. The shank is not easily to be maintained perpendicularly to the wall not only because the length of the shank is short, but also the hook portion affecting the force applying on the hook portion. This is more obvious when the operation for fixing the hook screws at a distance from the floor, the users need to hold the hook screws by one hand and to use the tool by the other hand.

The present invention intends to provide a positioning device that holds the hook screw in the device so that the user simply holding the tubular device without problem of positioning the hook screws.

SUMMARY OF THE INVENTION

In accordance with one aspect of the present invention, there is provided a positioning device for holding hook screws and the positioning device comprises a tubular body having a passage and a first slot is defined through a wall of the body and communicates a first open end of the body. A second slot is defined through a wall of the body and has two closed ends. A magnet is embedded in the wall of the body and located close to the first open end. A ring is received in a second open end of the body.

A holding assembly comprises a first piece movably mounted to the body and a second piece is fixedly mounted to the body. A spring is mounted to the body and biased between the first piece and the second piece. A rod is movably inserted into the passage via the second open end of the body and extends through the ring. A magnet is connected to a distal end of the rod and located in the body.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
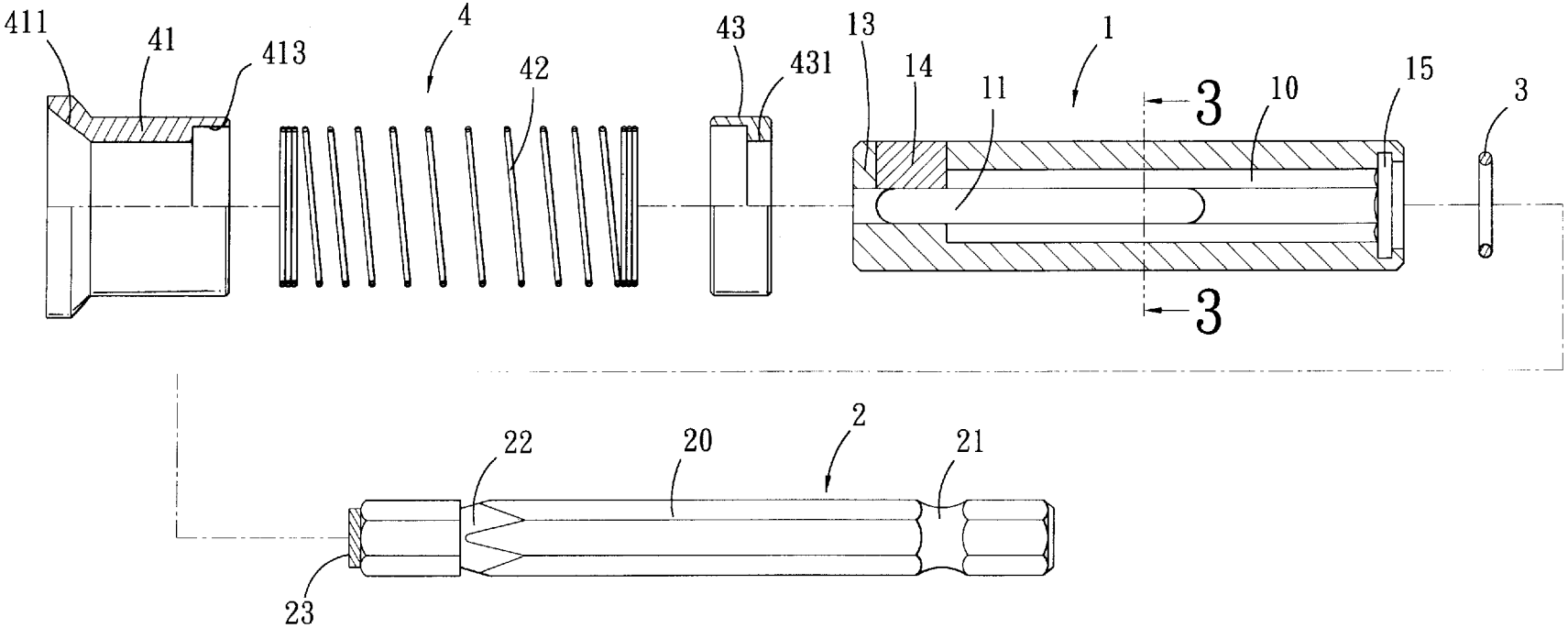
FIG. 1 is an exploded view to show the hook screw positioning device of the present invention.
Figure 2A:
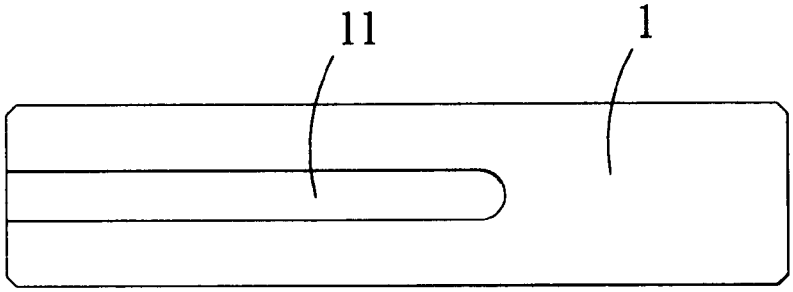
FIG. 2A shows a side view of the body of the hook screw positioning device of the present invention.
Figure 2B:
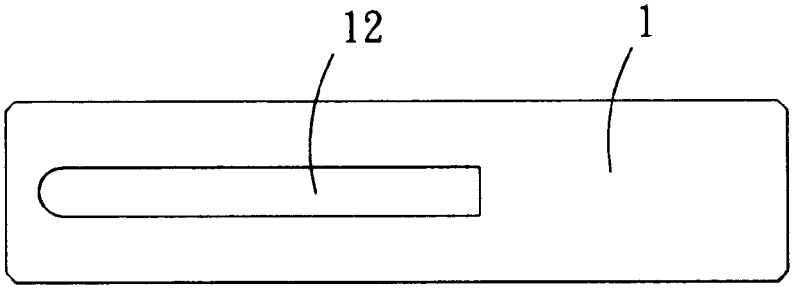
FIG. 2B shows the other side view of the hook screw positioning device of the present invention.
Figure 3:
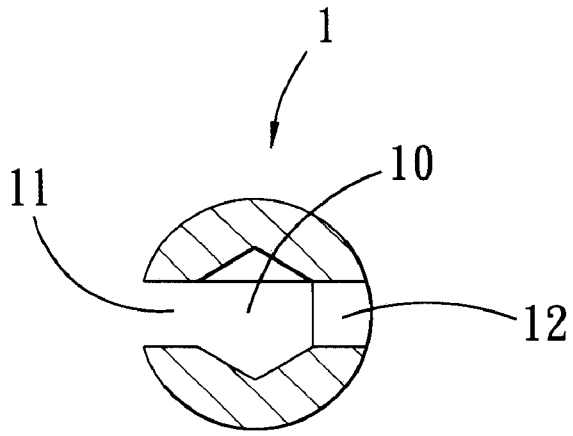
FIG. 3 shows a cross sectional view of the body of the hook screw positioning device of the present invention.

Referring to FIGS. 1, 2A, 2B and 3, the A positioning device for holding hook screws 31 of the present invention comprises a tubular body 1 which has a polygonal passage 10 defined longitudinally therethrough and a first slot 11 is defined through a wall of the body 1 and communicates with a first open end 13 of the body 1. A second slot 12 is defined through a wall of the body 1 and has two closed ends. A magnet 14 is embedded in the wall of the body 1 and located close to the first open end 13. A grove 15 is defined in an inner periphery of the passage 10 and located close to a second open end of the body 1. A ring 3 is received in the groove 15.

A holding assembly 4 comprises a first piece 41 movably mounted to the body 1 and a second piece 43 fixedly mounted to the body 1. The first piece 41 has a tapered opening 411 defined in a first end thereof and a groove 413 defined in a second end of the first piece 41. The second piece 43 has a shoulder 431 extending inward from an inner periphery thereof. A spring 42 is mounted to the body 1 and biased between the groove 413 of the first piece 41 and the shoulder 431 of the second piece 43. A length of the holding assembly 4 is the same as a length of the body 1.

A rod 2 having a polygonal outer periphery 20 is movably inserted into the passage 10 via the second open end of the body 1 and extends through the ring 3. A magnet 23 is connected to a first end of the rod 2 and located in the body 1. A first groove 22 is defined in the rod 2 and close to the first end of the rod 2. An outer diameter of the periphery of the first groove 22 is smaller than an inner diameter of the ring 3 so that once the rod 2 is inserted in the passage 10 by the first end that has the first groove 22, the rod is not disengaged from the passage 10. A second groove 21 is defined in outer periphery of the rod 2 and located at a second end of the rod 2 so as to be engaged with a tool which is not shown.

Figure 4:
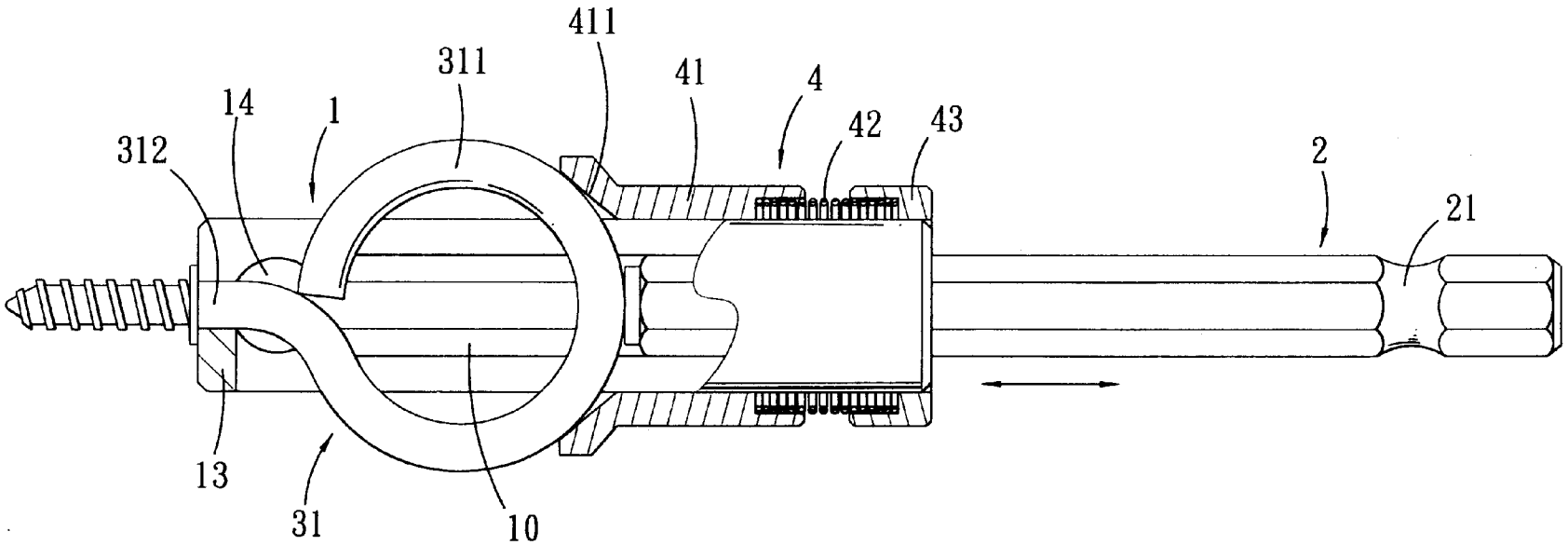
FIG. 4 shows a hook screw is positioned by the hook screw positioning device of the present invention.
Figure 5:
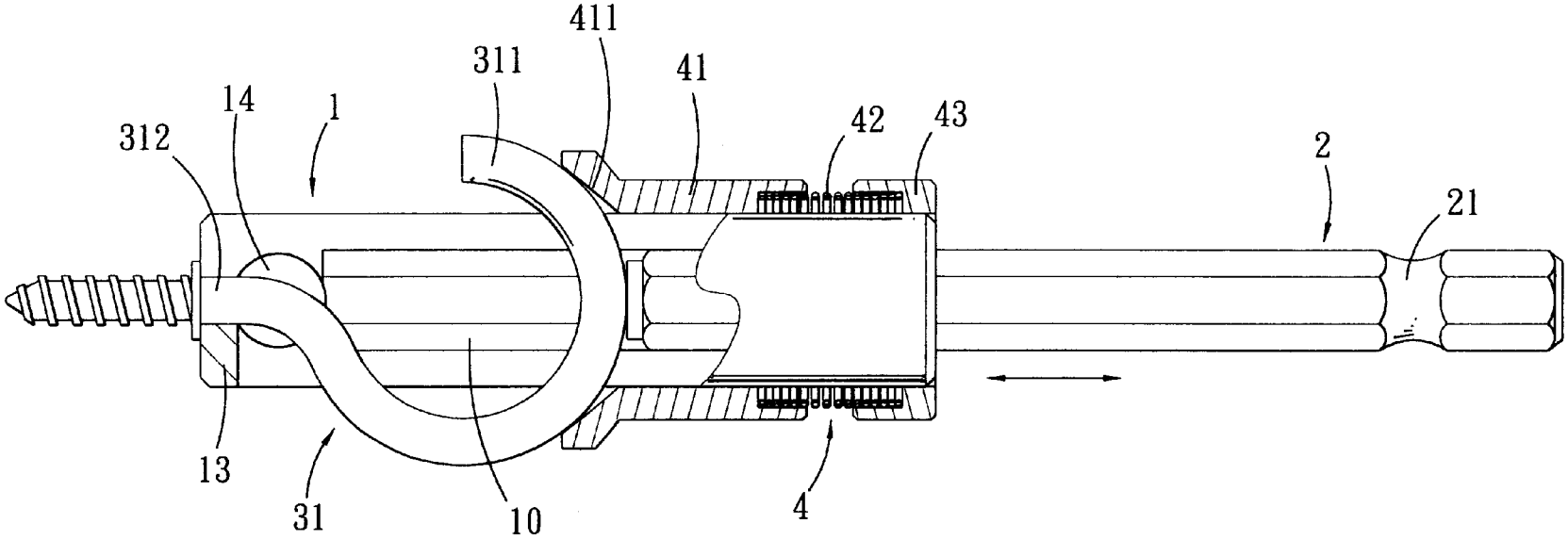
FIG. 5 shows another type of hook screw positioned by the hook screw positioning device of the present invention.

As shown in FIGS. 4 and 5, the hook screw 31 includes a hook portion 311 and a threaded shank portion 312. A width of each of the first slot 11 and the second slot 12 is larger than a diameter of a hook portion 311 of the hook screw 31. Therefore, the hook portion 311 can be slid into the first slot 11 and the second slot 12 with the shank portion 31 extending from the first open end 13. In the meanwhile, the first piece 41 is pushed to compress the spring 42 so that a force pushes the hook screw 31 forward. The tapered opening 411 of the first piece 41 is engaged the hook portion 311 of the hook screw 31 which is then positioned relative to the body 1. The magnet 14 attracts the shank portion 312 and the magnet 23 attracts the hook portion 311. By the device, the hook screw can be well positioned so that the user can concentrate his attention on the operation of a tool that fixes the hook screw 31 on the wall.

While we have shown and described the embodiment in accordance with the present invention, it should be clear to those skilled in the art that further embodiments may be made without departing from the scope of the present invention.

What is claimed is:

1. A positioning device for holding hock screws which includes a hook portion and a threaded shank portion, the positioning device comprising:

a tubular body having a passage defined longitudinally therethrough and a first slot defined through an annular wall of the body and communicating with a first open end of the body, a second slot defined through said annular wall of the body and having two closed ends, a magnet embedded in the wall of the body and located close to the first open end, a ring received in a second open end of the body;

a holding assembly comprising a first piece movably mounted to the body and a second piece fixedly mounted to the body, a spring mounted to the body and biased between the first piece and the second piece, and a rod movably inserted into the passage via the second open end of the body and extending through the ring, a magnet connected to a distal end of the rod and located in the body.

2. The device as claimed in claim 1, wherein a width of each of the first slot and the second slot is adapted to be larger than a diameter of the hook portion of the hook screw.

3. The device as claimed in claim 1, wherein a length of the holding assembly is the same as a length of the body.

4. The device as claimed in claim 1, wherein the first piece has a tapered opening defined in a first end thereof so as to be adapted to engage the hook portion of the hook screw.

5. The device as claimed in claim 1 further comprising a first groove defined in the rod and an outer diameter of the periphery of the first groove being smaller than an inner diameter of the ring.

* * * * *